US006398298B1

(12) United States Patent
Chen

(10) Patent No.: US 6,398,298 B1
(45) Date of Patent: Jun. 4, 2002

(54) FOLDABLE ROCKING CHAIR

(75) Inventor: Kao-Ming Chen, Kaohsiung Hsien (TW)

(73) Assignee: Sanmaw Lumber & Wood Mfg. Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/793,026

(22) Filed: Feb. 26, 2001

(51) Int. Cl.[7] ..... A47C 4/00; A47C 5/00

(52) U.S. Cl. ..... 297/41; 297/16.1; 297/18; 297/452.13; 297/35

(58) Field of Search ..... 297/16.1, 23, 41, 297/35, 18, 440.19, 440.18, 55, 56, 46, 20, 452.13

(56) References Cited

U.S. PATENT DOCUMENTS 1,694,933 A * 12/1928 Walker et al. ..... 297/56
2,713,890 A * 7/1955 Mack ..... 297/452.13
2,741,298 A * 4/1956 Roberts, III ..... 297/18

* cited by examiner

*Primary Examiner*—Anthony D. Barfield
(74) *Attorney, Agent, or Firm*—Ladas & Parry

(57) ABSTRACT

A foldable rocking chair includes a pair of first rods, a pair of second rods respectively associated and crossing the first rods, a pair of stretchers pivoted on the first and second rods adjacent to bottom ends of the first and second rods, a pair of arm supports disposed above the stretchers and pivoted on the first and second rods, and a flexible mat connected to top ends of the first and second rods.

5 Claims, 7 Drawing Sheets

FOLDABLE ROCKING CHAIR

BACKGROUND OF THE INVENTION

1. Field of the Invention

This invention relates to a chair, more particularly to a foldable rocking chair.

2. Description of the Related Art

FIG. 1 illustrates a conventional foldable chair 1 which includes a backrest 11, a seat framework 12, front and rear legs 14, and a leg supporter 13. A pivot mechanism interconnects the backrest 11, the seat framework 12, the front and rear legs 14, and the leg support 13 so as to permit folding of the chair 1. However, the chair 1 of this type cannot provide a rocking function. FIG. 2 illustrates a conventional rocking chair 2 including a chair body 21 and a rocking mechanism 22 mounted on a bottom of the chair body 21 so that the chair body 21 can be rocked on the rocking mechanism 22. However, the chair 2 of this type cannot be folded.

SUMMARY OF THE INVENTION

Therefore, it is an object of the present invention to provide a foldable rocking chair that is foldable and that is capable of providing a rocking function.

According to the present invention, a foldable rocking chair comprises: parallel first left and right support rods of equal lengths and having first top and bottom ends; a first cross rod interconnecting the first top ends of the first left and right support rods; parallel second left and right support rods of equal lengths and respectively associated with the first left and right support rods and having second top and bottom ends, each of the second left and right support rods crossing a respective one of the first left and right support rods so as to define an intersection therebetween and so as to divide the respective one of the first left and right support rods into first front and rear sections relative to the intersection and so as to divide each of the second left and right support rods into second front and rear sections relative to the intersection, the first front section extending downwardly from the intersection to the first bottom end, the first rear section extending upwardly from the intersection to the first top end, the second front section extending upwardly from the intersection to the second top end, the second rear section extending downwardly from the intersection to the second bottom end; a second cross rod interconnecting the second bottom ends of the second left and right support rods and having a length greater than that of the first cross rod; a left stretcher disposed between the first and second left support rods and having two opposite ends respectively pivoted on the first front section of the first left support rod and the second rear section of the second left support rod; a right stretcher disposed between the first and second right support rods and having two opposite ends respectively pivoted on the first front section of the first right support rod and the second rear section of the second right support rod; an L-shaped left arm support disposed above the left stretcher and having a first end pivoted on the first rear section of the first left support rod, and a second end pivoted on the second front section of the second left support rod; an L-shaped right arm support disposed above the right stretcher and having a first end pivoted on the first rear section of the first right support rod, and a second end pivoted on the second front section of the second right support rod; a cross member interconnecting the second front sections of the second left and right support rods and disposed adjacent to the top ends of the second left and right support rods; a flexible mat having two opposite ends respectively secured to the first cross rod and the cross member and extending between the first left and right support rods; and a stop member mounted on the first front sections of the first left and right support rods below the second front sections of the second left and right support rods for limiting downward movement of the second front sections of the second left and right support rods upon rotation of the second left and right support rods relative to the left and right stretchers when an external downward force is applied on the second front sections of the second left and right support rods via the cross member.

BRIEF DESCRIPTION OF THE DRAWINGS

In drawings which illustrate an embodiment of the invention.

DETAILED DESCRIPTION OF THE PREFERRED EMBODIMENT

Figure 1:
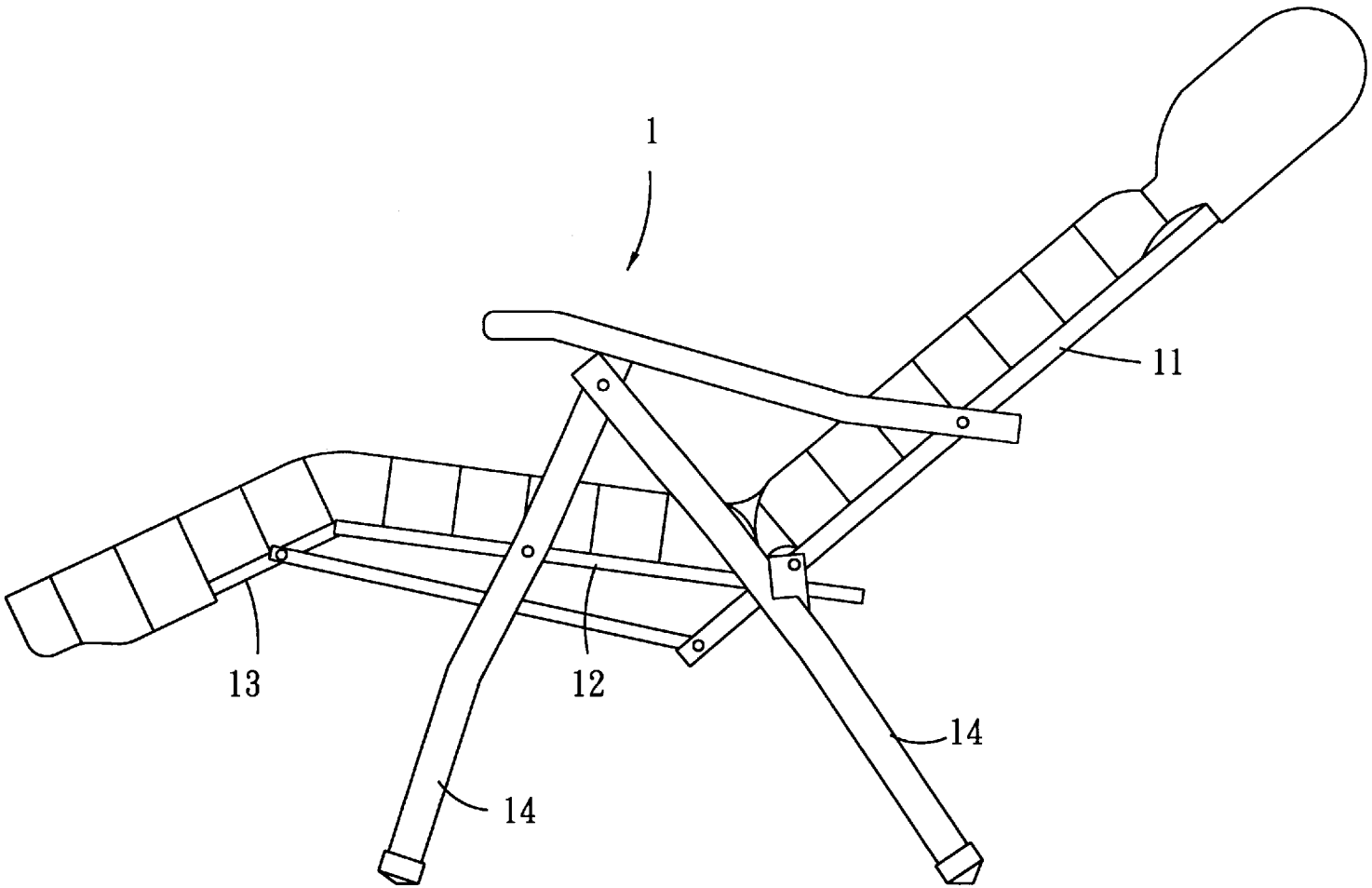
FIG. 1 PRIOR ART
FIG. 1 is a side view of a conventional foldable chair.
Figure 2:
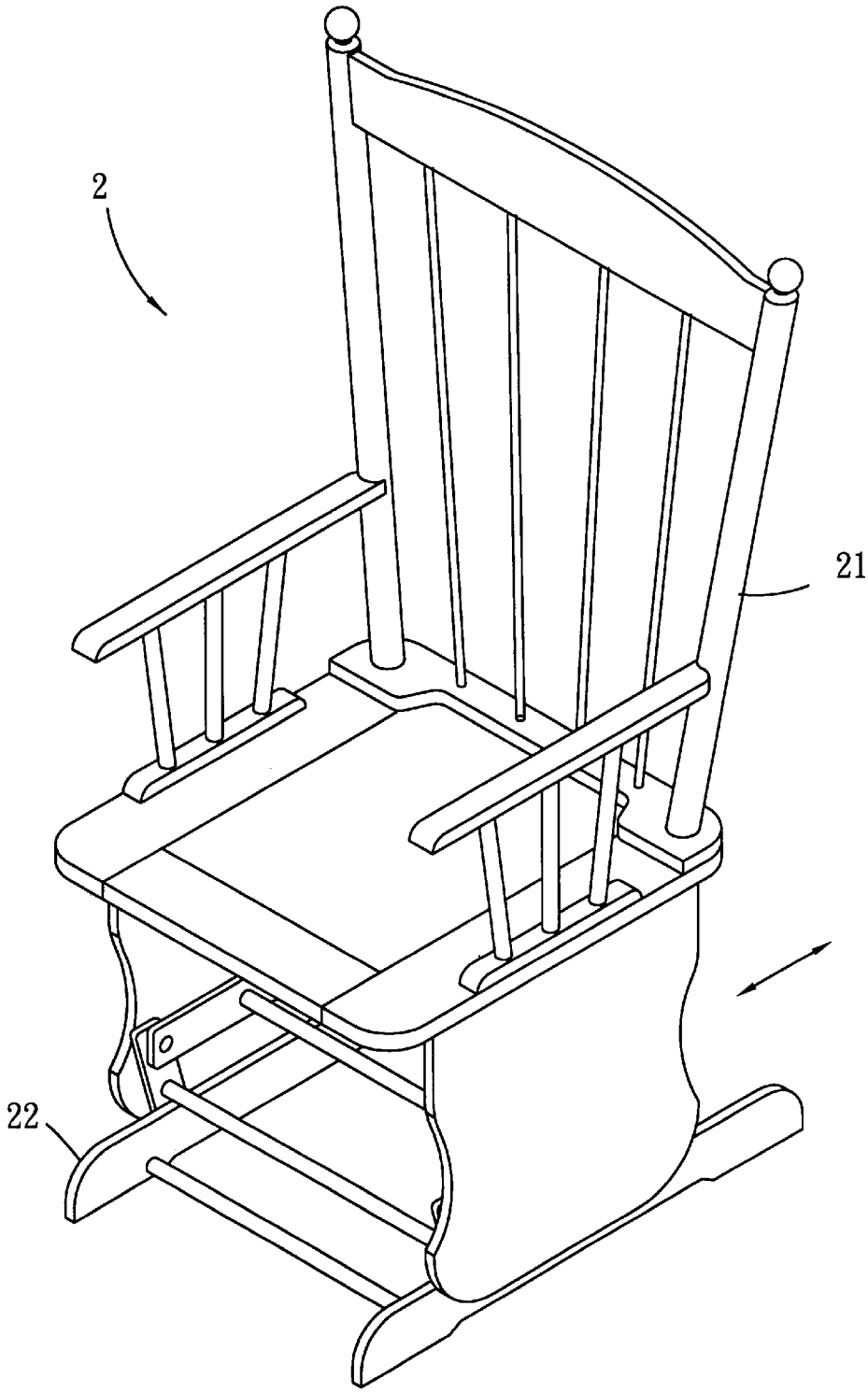
FIG. 2 PRIOR ART
FIG. 2 is a perspective view of a conventional rocking chair.
Figure 3:
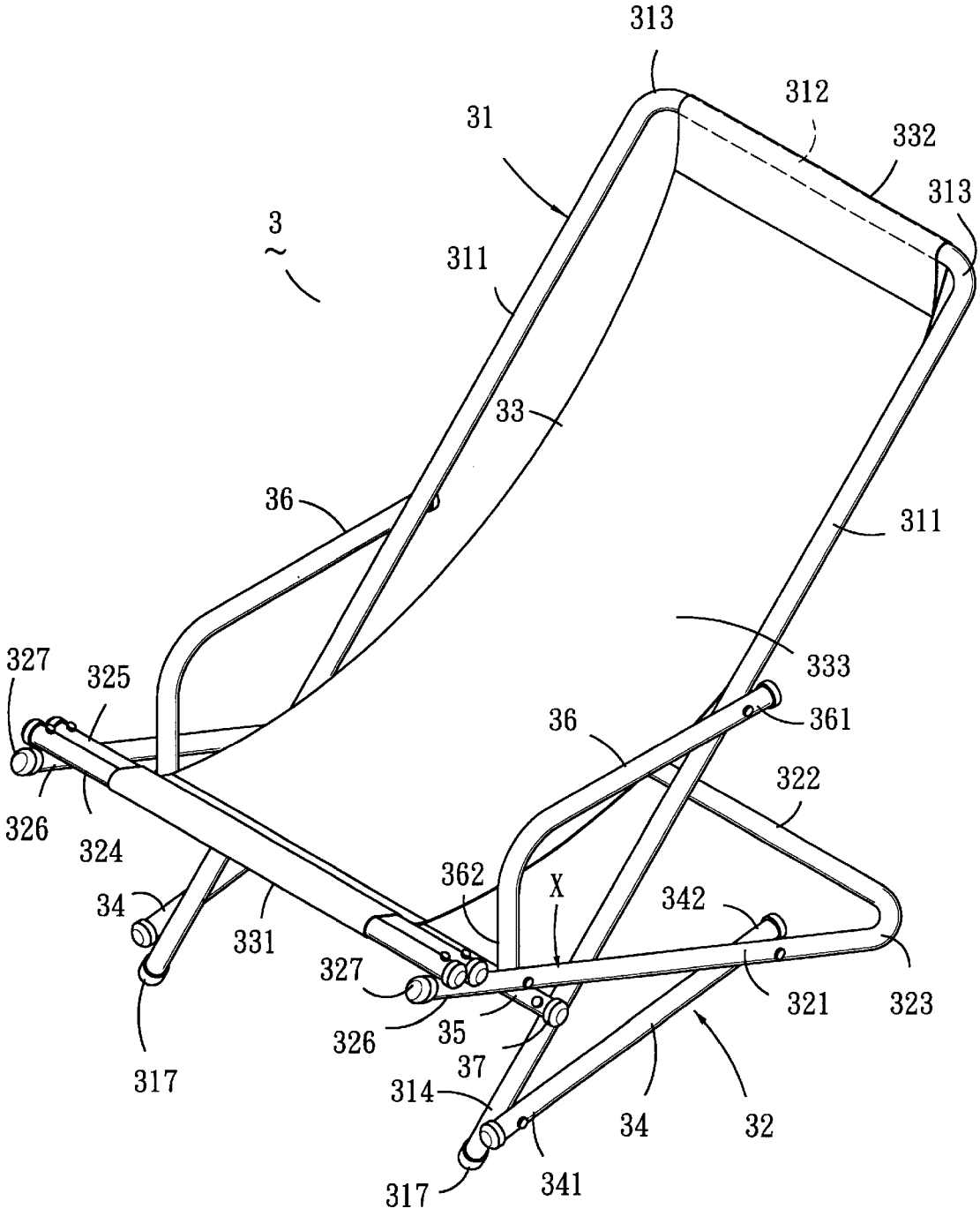
FIG. 3 is a perspective view of a foldable rocking chair embodying this invention.
Figure 7:
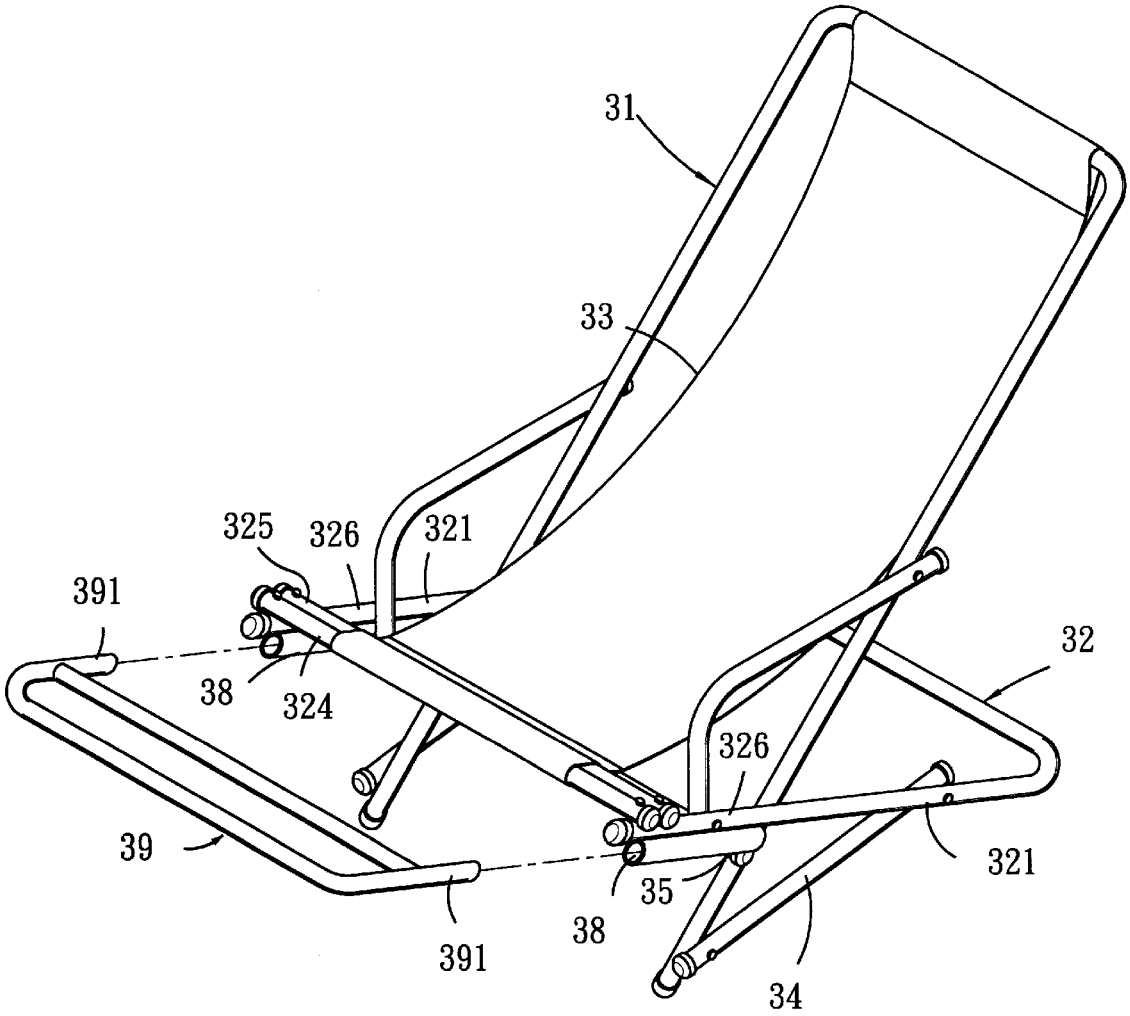
FIG. 7 shown a modification to the rocking chair of FIG. 3.

FIGS. 3 and 7 illustrate a foldable rocking chair 3 embodying this invention. The chair 3 includes: parallel first left and right support rods 31 of equal lengths and having first top and bottom ends 313, 317; a first cross rod 312 interconnecting the first top ends 313 of the first left and right support rods 31; parallel second left and right support rods 32 of equal lengths and respectively associated with the first left and right support rods 31 and having second top and bottom ends 323, 327, each of the second left and right support rods 32 crossing a respective one of the first left and right support rods 31 so as to define an intersection (indicated as reference character "X" in FIG. 3) therebetween and so as to divide the respective one of the first left and right support rods 31 into first front and rear sections 314, 311 relative to the intersection (X) and so as to divide each of the second left and right support rods 32 into second front and rear sections 326, 321 relative to the intersection (X), the first front section 314 extending downwardly from the intersection (X) to the first bottom end 317, the first rear section 311 extending upwardly from the intersection (X) to the first top end 313, the second front section 326 extending upwardly from the intersection (X) to the second top end 327, the second rear section 321 extending downwardly from the intersection (X) to the second bottom end 323; a second cross rod 322 interconnecting the second bottom ends 323 of the second left and right support rods 32 and having a length greater than that of the first cross rod 312; a left stretcher 34, in the form of a rod, that is disposed between the first and second left support rods 31, 32 and that has two opposite ends 341, 342 respectively pivoted on the first front section 314 of the first left support rod 31 and the second rear section 321 of the second left support rod 32; a right stretcher 34, in the form of a rod, that is disposed between the first and second right support rods 31, 32 and that has two opposite ends 341, 342 respectively pivoted on the first front section 314 of the first right support rod 31 and the second rear section 321 of the second right support rod 32; an L-shaped left arm support 36, in the form of an L-shaped rod, that is disposed above the left stretcher 34 and having a first end 361 pivoted on the first rear section 311 of the first left support rod 31, and a second end 362 pivoted on the second front section 326 of the second left support rod 32; an L-shaped right arm support 36, in the form of an L-shaped rod, that is disposed above the right stretcher 34 and having a first end 361 pivoted on the first rear section 311 of the first right support rod 31, and a second end 362 pivoted on the second front section 326 of the second right support rod 32; a cross member including a pair of juxtaposed rods 324, 325 that interconnect the second front sections 326 of the second left and right support rods 32 and that are disposed adjacent to the second top ends 327 of the second left and right support rods 32; a flexible mat 33, such as a canvas sheet, having two opposite ends 332, 331 respectively secured to the first cross rod 312 and the cross member and extending between the first left and right support rods 31; a stop member 35, in the form of a rod, that is mounted on the first front sections 314 of the first left and right support rods 31 below the second front sections 326 of the second left and right support rods 32 for limiting downward movement of the second front sections 326 of the second left and right support rods 32 upon rotation of the second left and right support rods 32 relative to the left and right stretchers 34 when an external downward force is applied on the second front sections 326 of the second left and right support rods 32 via the cross member; and a U-shaped rod 39 having two opposite ends 391 respectively connected to the second top ends 327 of the second left and right support rods 32. An elastic member 37 is sleeved on each of the opposite ends of the stop member 35 underneath the second front section 326 of a respective one of the second left and right support rods 32 so as to provide a cushioning effect when the second front sections 326 of the second left and right support rods are brought into contact with the stop member 35.

Figure 4:
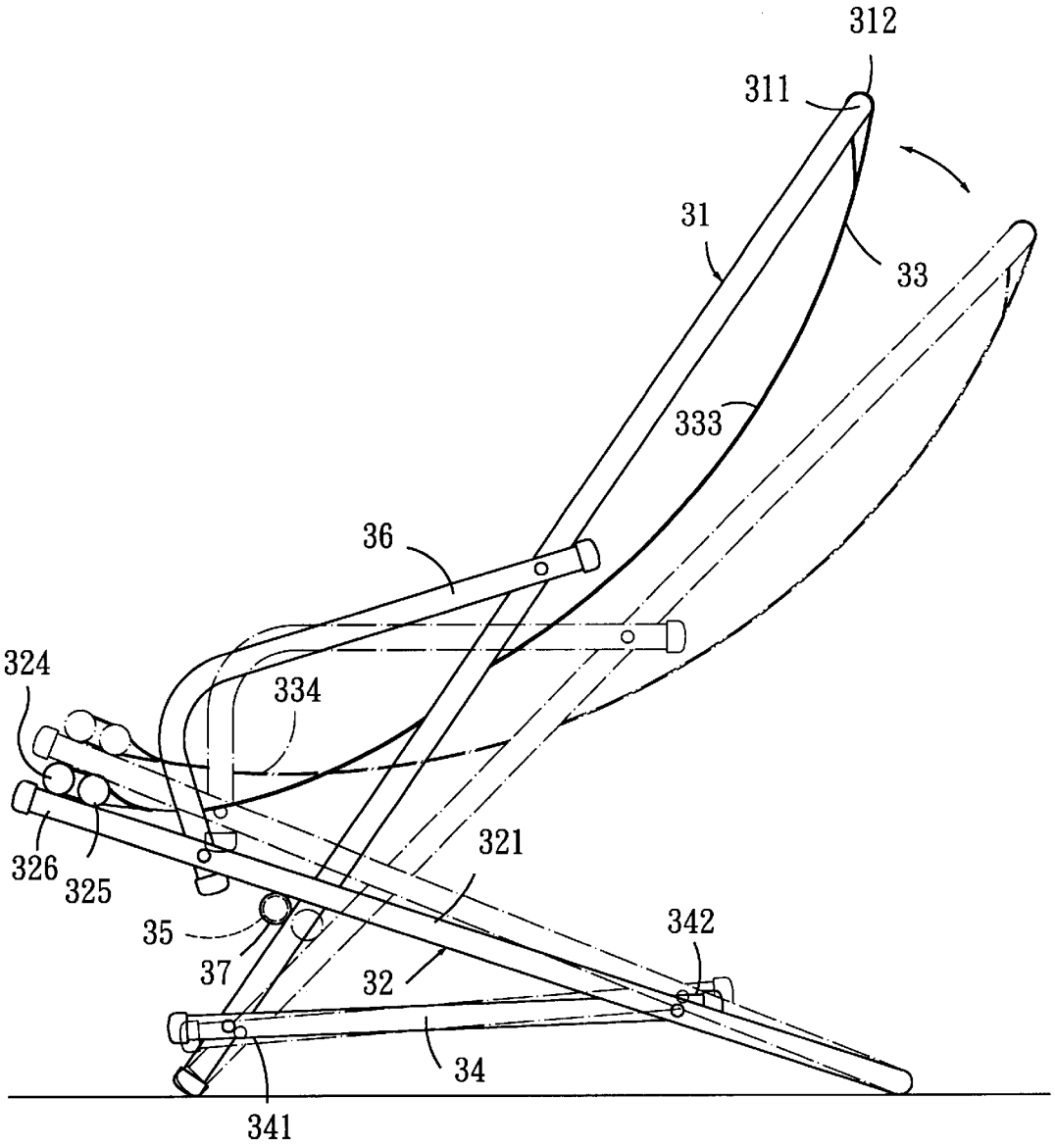
FIG. 4 is a side view to illustrate the foldable rocking chair of FIG. 3, in a rocking state.

As illustrated in FIG. 4, the foldable rocking chair 3 can be rocked back and forth. When an external force is applied on the top portion 333 of the mat 33, the first left and right support rods 31 will turn rearwardly and downwardly relative to the left and right stretchers 34, which, in turn, will pull the second left and right support rods 32 to turn rearwardly and upwardly relative to the left and right stretchers 34 via the left and right arm supports 36, and when an external force is applied on the bottom portion 334 of the mat 33, the second left and right support rods 32 will turn frontwardly and downwardly relative to the left and right stretchers 34, which, in turn, will pull the first left and right support rods 31 to turn frontwardly and upwardly relative to the left and right stretchers 34 via the left and right arm supports 36.

Preferably, the second cross rod 322 is substantially flush with the first cross rod 312 when the chair 3 is in an extended condition so as to enhance the stability of the chair 3.

Figure 5:
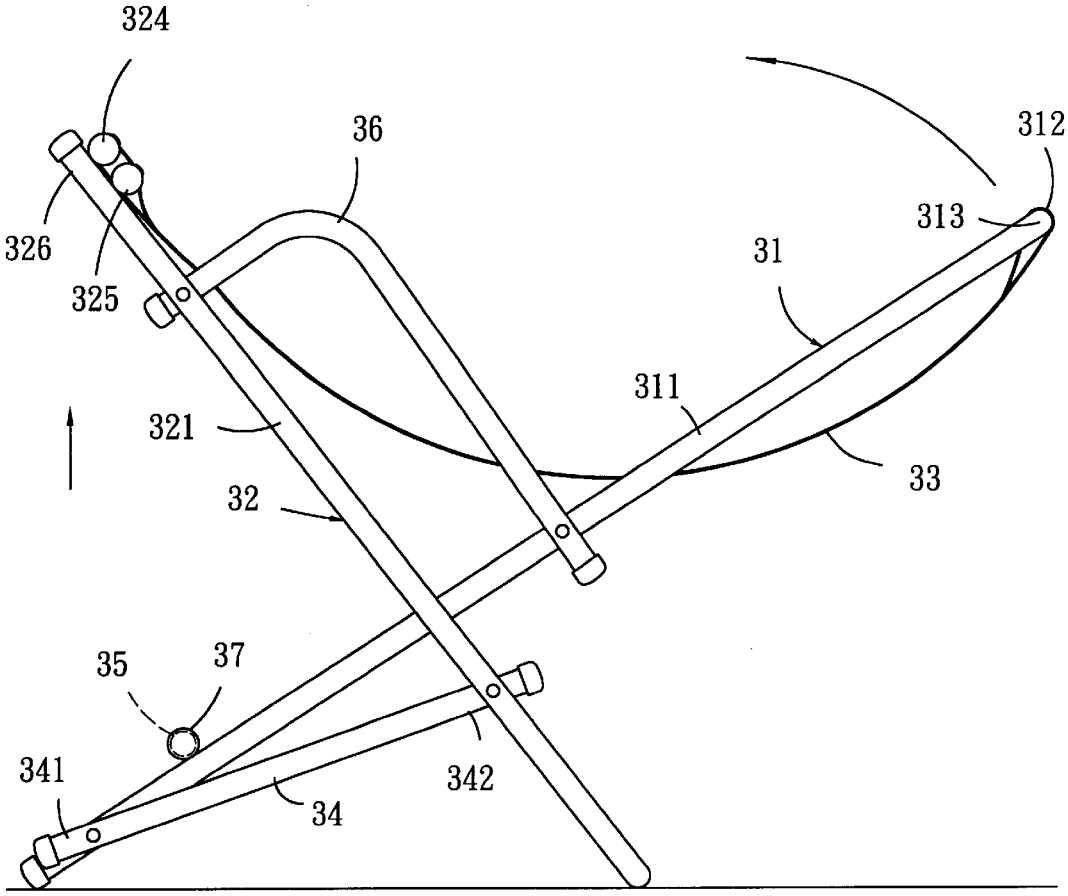
FIG. 5 is a side view to illustrate the foldable rocking chair of FIG. 3, in a folding state.
Figure 6:
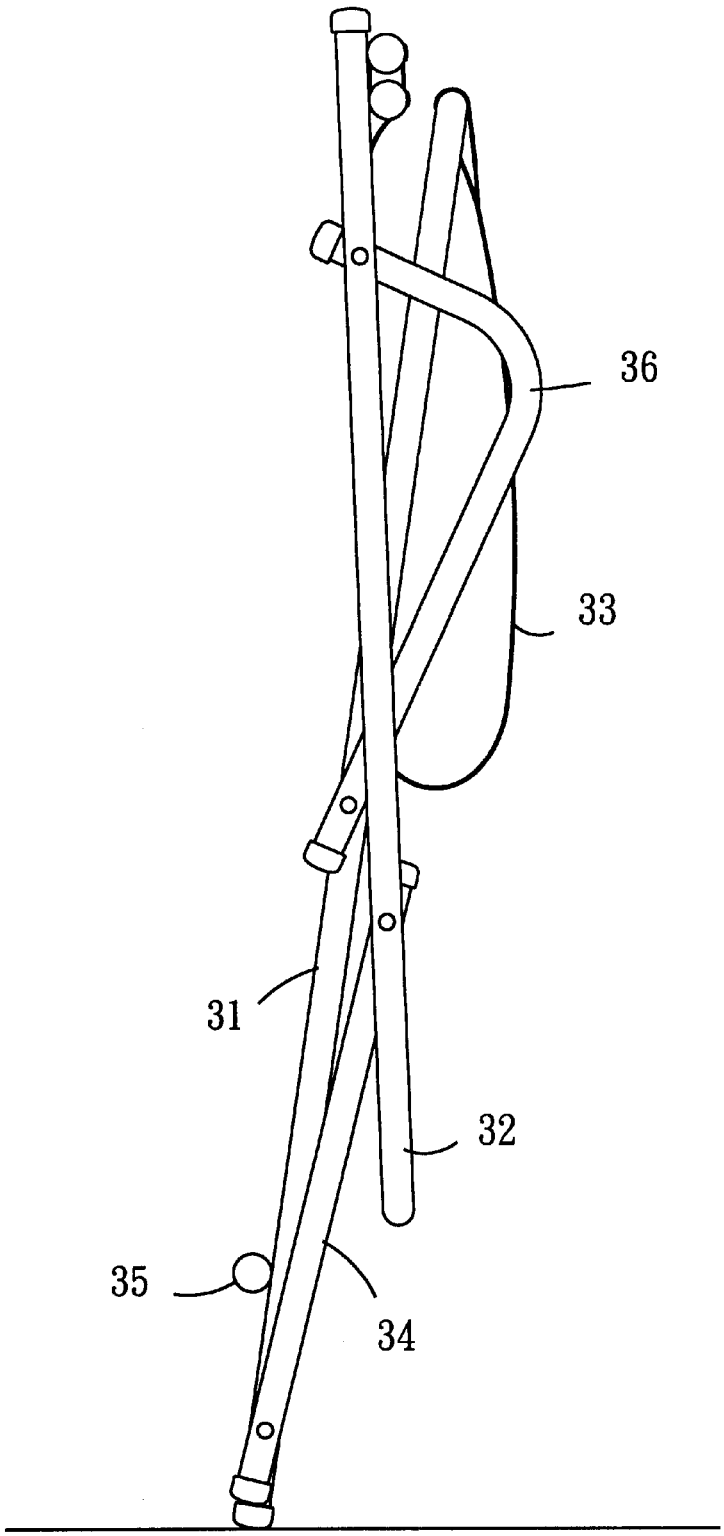
FIG. 6 is a side view to illustrate the foldable rocking chair of FIG. 3, in a fully folded, state.

As illustrated in FIGS. 5 and 6, the chair 3 can be simply folded by pushing the first rear sections 311 of the first left and right support rods 31 and the second front sections 326 of the second left and right support rods 32 toward each other to turn the first left and right support rods 31 and the second left and right support rods 32 relative to the left and right stretchers 34.

With the invention thus explained, it is apparent that various modifications can be made without departing from the spirit of the present invention. It is therefore intended that the invention be limited only as recited in the appended claims.

I claim:

1. A foldable rocking chair comprising:

parallel first left and right support rods of equal lengths and having first top and bottom ends;

a first cross rod interconnecting said first top ends of said first left and right support rods;

parallel second left and right support rods of equal lengths and respectively associated with said first left and right support rods and having second top and bottom ends, each of said second left and right support rods crossing a respective one of said first left and right support rods so as to define an intersection therebetween and so as to divide the respective one of said first left and right support rods into first front and rear sections relative to said intersection and so as to divide each of said second left and right support rods into second front and rear sections relative to said intersection, said first front section extending downwardly from said intersection to said first bottom end, said first rear section extending upwardly from said intersection to said first top end, said second front section extending upwardly from said intersection to said second top end, said second rear section extending downwardly from said intersection to said second bottom end;

a second cross rod interconnecting said second bottom ends of said second left and right support rods and having a length greater than that of said first cross rod;

a left stretcher disposed between said first and second left support rods and having two opposite ends respectively pivoted on said first front section of said first left support rod and said second rear section of said second left support rod;

a right stretcher disposed between said first and second right support rods and having two opposite ends respectively pivoted on said first front section of said first right support rod and said second rear section of said second right support rod;

an L-shaped left arm support disposed above said left stretcher and having a first end pivoted on said first rear section of said first left support rod, and a second end pivoted on said second front section of said second left support rod;

an L-shaped right arm support disposed above said right stretcher and having a first end pivoted on said first rear section of said first right support rod, and a second end pivoted on said second front section of said second right support rod;

a cross member interconnecting said first front sections of said second left and right support rods and disposed adjacent to said second top ends of said second left and right support rods;

a flexible mat having two opposite ends respectively secured to said first cross rod and said cross member and extending between said first left and right support rods; and a stop member mounted on said first front sections of said first left and right support rods below said second front sections of said second left and right support rods for limiting downward movement of said second front sections of said second left and right support rods upon rotation of said second left and right support rods relative to said left and right stretchers when an external downward force is applied on said second front sections of said second left and right support rods via said cross member.

2. The foldable rocking chair of claim 1, wherein each of said left and right stretchers is formed as a rod.

3. The foldable rocking chair of claim 1, wherein each of said left and right arm supports is formed as an L-shaped rod.

4. The foldable rocking chair of claim 1, wherein said stop member is formed as a rod which has two opposite ends securely connected to said first front sections of said first left and right support rods.

5. The foldable rocking chair of claim 1, further comprising a U-shaped rod having two opposite ends respectively connected to said second top ends of said second left and right support rods.

* * * * *